United States Patent [19]

Moen

[11] 4,083,161

[45] Apr. 11, 1978

[54] ANCHOR BOLT ASSEMBLY

[76] Inventor: George A. Moen, 827 W. 26th Ave., Anchorage, Ak. 99503

[21] Appl. No.: 776,778

[22] Filed: Mar. 11, 1977

[51] Int. Cl.[2] ..... E04C 5/18

[52] U.S. Cl. ..... 52/699; 249/213; 85/50 R

[58] Field of Search ..... 249/213–218; 52/699; 85/50 R

[56] References Cited

U.S. PATENT DOCUMENTS

| | | | |
|---|---|---|---|
| 660,084 | 10/1900 | Smith | 249/217 |
| 1,323,067 | 11/1919 | Keith | 52/699 |
| 1,503,148 | 7/1924 | Bernstrom | 52/699 |
| 1,602,217 | 10/1926 | Wessel | 85/50 |
| 1,849,604 | 3/1932 | Weatherhead | 85/50 |
| 1,851,339 | 3/1932 | Williams | 249/217 |
| 1,875,463 | 9/1932 | Jones | 249/215 |
| 2,069,085 | 1/1937 | Day | 249/216 |

*Primary Examiner*—James L. Ridgill, Jr.
*Attorney, Agent, or Firm*—Lawrence E. Laubscher

[57] ABSTRACT

An anchor bolt assembly for supporting an anchor bolt to be embedded in a concrete structure is disclosed. In a first embodiment, the assembly includes a cup-shaped washer which is threadedly mated with the anchor bolt. A concrete form is provided with a through-bore through which the free end of the bolt passes while the washer is disposed in abutting contact with one surface of the form. Nails are driven through the washer and into the form so as to secure the washer-bolt assemblage to the form. Nuts may be threadedly mated upon both ends of the bolt in order to provide rigidifying forces to the assembly and additional anchor retaining forces for the bolt when the latter is embedded in the concrete. The assembly may be utilized in forming concrete ceilings, floors, walls, or columns.

In a second embodiment, two washers are employed. The washers are disposed upon opposite surfaces of the concrete form and in conjunction with one of the washers, locator pins or spikes are provided in order to prelocate the washer relative to the form through-bore so as to facilitate assemblage of the anchor bolt assembly. The dual washer assembly also readily facilitates the repetitive formation of the concrete ceilings, floors, walls, or columns.

7 Claims, 4 Drawing Figures

ANCHOR BOLT ASSEMBLY

BACKGROUND OF THE INVENTION

1. Field of the Invention

The present invention relates generally to anchor bolt assemblies and more particularly to an anchor bolt assembly which will properly support an anchor bolt while the same is embedded within a concrete structure at predetermined locations thereof.

2. Description of the Prior Art

In the construction of commercial and industrial buildings, particularly multi-story buildings, the floors and ceilings defining each story of the building are normally fabricated of concrete. This is likewise true with respect to the construction of the buildings' support columns and walls. In conjunction with the construction of the buildings per se, accessories necessary for the normal operation of the business establishments occupying such buildings must also be provided. Lighting fixtures, electrical and telephone wire raceways and outlets, heat and air conditioning ductwork, or the like, are examples of such accessories. In accordance with conventional practices, the accessories are normally secured to and supported upon or from the concrete structures defining the building floors, ceilings, support columns, and walls.

In order to secure and support such accessories upon the concrete structures, suitable male or female fasteners or anchors must initially be secured to the concrete structures, and subsequently, the accessories may, in turn, be secured to the anchors. One conventional method of securing the anchors to the concrete structures involves the manual insertion of the anchors into the concrete after the same has been poured but before it has completely hardened or set. This technique is quite impractical, however, as not all areas of, for example, a large concrete slab or mass are accessible. In addition, as the anchors must be individually inserted within the concrete, considerable time and labor must be expended. Still further, the anchors are not always accurately aligned in predetermined directions with respect to the concrete structures.

Another method commonly employed for securing the anchors to the concrete structures involves the drilling of holes in the hardened concrete and the insertion of expansion anchors thereinto. The drilling operation, however, is difficult to perform, and again, is quite time consuming. In addition, the holes for the anchors cannot always be drilled at every desirable location due to, for example, interference problems with reinforcement structures already embedded within the concrete.

OBJECTIVES OF THE INVENTION

Accordingly, it is an object of the present invention to provide an anchor bolt assembly which is adapted to resolve the various aforenoted problems prevalent within the prior art.

Another object of the present invention is to provide an anchor bolt assembly which will readily facilitate an anchor bolt to be embedded within a concrete structure.

Still another object of the present invention is to provide an anchor bolt assembly which will readily facilitate an anchor bolt to be embedded within a concrete structure without requiring the expenditure of an inordinate amount of time and labor.

Yet another object of the present invention is to provide an anchor bolt assembly which will readily facilitate an anchor bolt to be embedded within a concrete structure at predetermined locations thereof.

A further object of the present invention is to provide an anchor bolt assembly which will fixedly support the anchor bolt thereof such that the latter will be properly oriented with respect to the concrete structure within which the bolt is embedded.

A still further object of the present invention is to provide an anchor bolt assembly which will fixedly secure an anchor bolt within a concrete structure so as to adequately support building accessorial components.

A yet further object of the present invention is to provide an anchor bolt assembly which may be employed in selectively alternative or reverse modes with respect to the particular concrete structure being formed and within which the anchor bolt of the assembly is being embedded.

An additional object of the present invention is to provide an anchor bolt assembly which is comprised of a relatively small number of component parts so as to simplify assemblage of the assembly.

A still additional object of the present invention is to provide an anchor bolt assembly which is relatively inexpensive to manufacture.

BRIEF DESCRIPTION OF THE INVENTION

The foregoing and other objects are achieved in accordance with the present invention through means of the provision of an anchor bolt assembly which, in a first embodiment, includes a cup-shaped washer or member threadedly mated with an anchor bolt. A concrete form is provided with a through-bore through which the free end of the bolt passes while the washer is disposed in abutting contact with one surface of the form. Nails are driven through the washer and into the form so as to secure the washer-bolt assemblage to the form. Nuts may be threadedly mated upon both ends of the bolt in order to provide rigidifying forces to the assembly and additional anchor retaining forces for the bolt when the latter is embedded in the concrete.

The assembly may be utilized in a variety of modes when forming concrete ceilings, floors, walls, or columns. The washer also includes lock-nut or lock-washer structure, and depending upon the particular mode of use of the assembly relative to the concrete form, that is, whether or not the washer element is embedded within the concrete mass along with the anchor bolt, a recessed cavity may or may not be formed about the anchor bolt. The recessed cavity is sometimes preferred in order to accommodate, for example, female connectors adapted to be coupled to the male anchor bolt.

In a second embodiment, two washers are employed, the same being disposed upon opposite surfaces of the concrete form. In conjunction with one of the washers, locator pins or spikes are provided in order to prelocate the washer relative to the form through-bore in facilitating assemblage of the anchor bolt assembly. The dual washer assembly also readily facilitates the repetitive formation of concrete ceilings and floors, for example.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
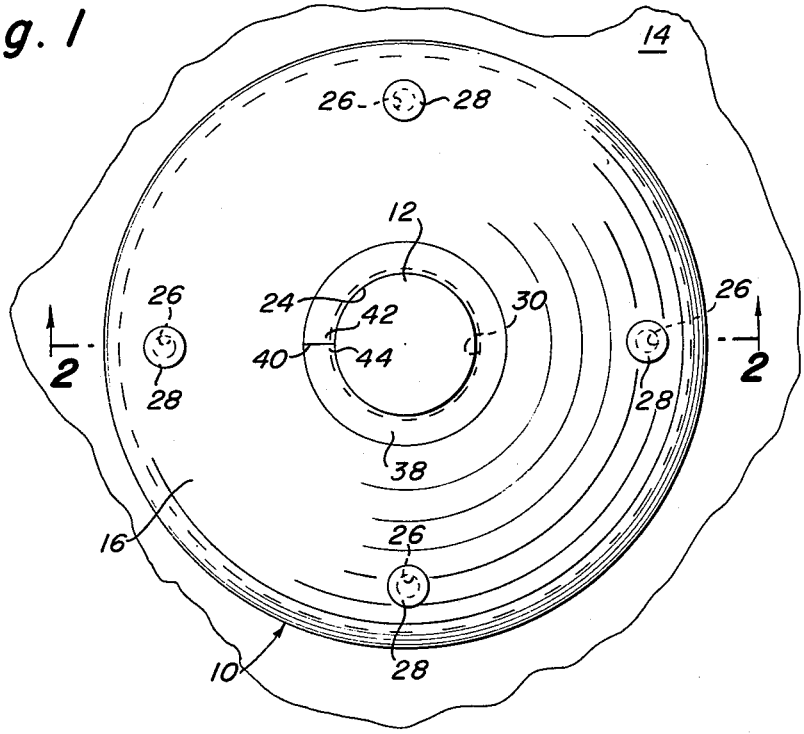
FIG. 1 is a plan view of a first embodiment of an anchor bolt assembly constructed in accordance with the present invention and showing its cooperative parts.
Figure 2:
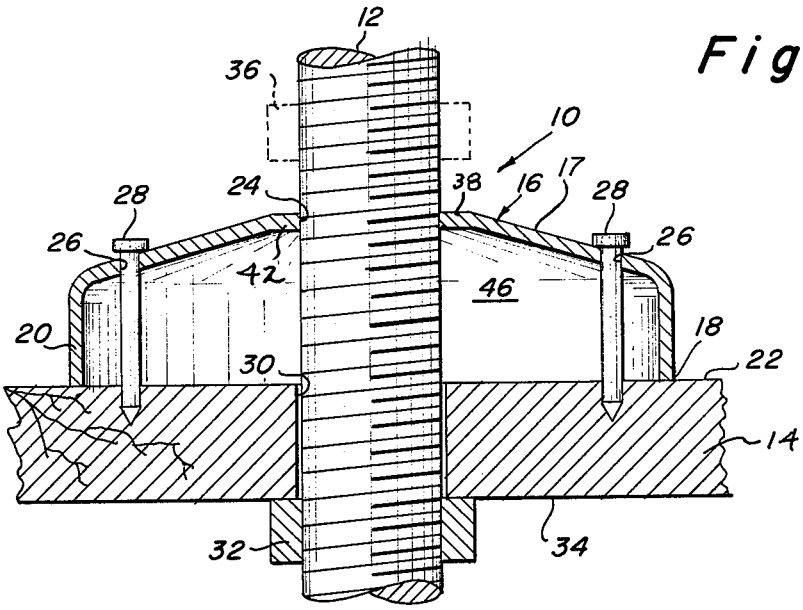
FIG. 2 is a cross-sectional view of the anchor bolt assembly of FIG. 1 taken along lines 2—2 of FIG. 1.

Referring now to the drawings, and more particularly to FIGS. 1 and 2 thereof, a first embodiment of an anchor bolt assembly as constructed in accordance with the present invention is generally indicated by the reference character 10. The assembly serves to support a threaded anchor bolt 12 such that the same will have a particularly defined orientation relative to a concrete structure which may, for example, be a ceiling, floor, column, wall, or the like.

In forming the concrete structure, a wooden form, a portion of which is shown at 14, is conventionally employed for defining the concrete structure, and in accordance with the present invention, the assembly 10 is adapted to be secured to the form 14 prior to the pouring of the concrete into the form. The assembly 10 is seen to include an inverted cup-shaped washer member 16 including a generally disk-shaped body portion 17 and an annular generally cylindrical spacer flange portion 20 connected at one end with the peripheral edge portion of the body. The washer 16 rests upon form 14 with the free end 18 of the washer's flange portion 20 being in contact with the upper surface 22 of form 14.

An aperture 24 is centrally defined within the base wall of washer 16, and the diameter of aperture 24 is seen to be substantially equal to the inner diameter of the threaded shank of bolt 12. Washer 16 is preferably stamped from sheet metal stock material having a preselected thickness. The thickness of such material is such that together with the diametrical dimensional characteristic of aperture 24, washer 16 may be threadedly engaged with bolt 12 by means of the central peripheral wall defining aperture 24.

A plurality of knock-out holes or fastening apertures 26, such as, for example, four, are also formed within the base wall of washer 16. The holes are all located upon a circular locus which is concentric with aperture 24 and which is located near the outer periphery of washer 16. A plurality of suitable fasteners 28, such as, for example, nails, are respectively inserted through holes 26 and are adapted to be driven into form 14. Holes 26 are equiangularly disposed about washer 16, and in this manner fasteners 28 are inserted within form 14 in a uniform and symmetrical arrangement so as to securely fasten washer 16 thereto.

Form 14 is provided with a through-bore 30, the diametrical extent of which is slightly larger than the outside diameter of bolt 12 so as to permit bolt 12 to pass freely therethrough. It is of course to be appreciated that through-bore 30 is formed within form 14 at a predetermined location thereof, and assembly 10 fixed to form 14 at such location, such that anchor bolt 12 will be embedded at a predetermined location with respect to the poured concrete mass.

In assembling the anchor bolt apparatus, bolt 12 is initially threadedly engaged with washer 16. The lower end of bolt 12 is then inserted through through-bore 30 until the free end 18 of the washer peripheral wall abuts the upper surface 22 of form 14. Nails 28 may then be inserted through holes 26 and into form 14, and subsequently, an anchoring nut 32 is threadedly secured upon the lower portion of bolt 12 below form 14. Nut 32 is preferably threaded upon bolt 12 until the same abuts the lower surface 34 of form 14, and in this manner, the assembly 10 is rigidly secured to and supported upon concrete form 14. Alternatively, however, nut 32 may be secured upon bolt 12 prior to the insertion of nails 28 through holes 26 and into form 14. This mode serves to provide rigidity to the washer 16 as the nails 28 are being driven therethrough into form 14.

The assembly of the present invention may be employed in a variety of ways depending upon the concrete structure being formed and the type of anchor structure to which access is to be provided. For example, in forming a concrete slab or floor, form 14 will be conventionally disposed over the area within which the concrete will be subsequently poured in order to form the floor or slab. The undersurface 34 of form 14 will therefore form the upper surface of the concrete floor with the lower portion of bolt 12 being embedded within the poured concrete.

While nut 32 is shown in abutment with the undersurface of form 14, the same may be selectively threadedly adjusted to various positions along the lower portion of bolt 12 so as to be disposed at some position spaced from the undersurface 34 of form 14. Consequently, in the latter instance, the entire nut will be embedded within the concrete mass when the form 14 and the other components of the assembly 10 are removed. In the former instance, wherein nut 32 abuts surface 34, the upper surface of the nut will be exposed and flush with the upper surface of the concrete mass when the form 14 and other components of the assembly 10 are removed.

While both arrangements concerning the disposition of nut 32 serve to securely embed the anchor bolt 12 within the concrete mass, additional rigidity is imparted to the assembly relative to form 14 when nut 32 abuts undersurface 34, however, additional anchoring or retaining forces are imparted to the bolt 12 when the nut 32 is entirely embedded within the mass. In either instance, when form 14 and the other components of the assembly are removed, only the upper portion of anchor bolt 12 projects upwardly from the surface of the concrete mass with the latter being contiguously disposed about anchor 12.

In order to remove form 14 and the other components of the assembly 10 from the concrete structure, nails 28 are initially removed from form 14 and washer 16 and subsequently, washer 16 is threadedly disengaged from the upper projecting portion of anchor bolt 12. Form 14 is then able to be moved upwardly and removed upon clearing the upper end of the projecting anchor 12.

As an alternative mode of using assembly 10, the entire apparatus may again be arranged as disclosed in FIG. 2, however, the form 14 will now be disposed below the poured concrete. In other words, the concrete will be poured onto the upper surface 22 of form 14 in order to, for example, form a ceiling or roof. As a result, the concrete will encapsulate the upper portion of anchor bolt 12 as well as the entire washer 16 and nails 28. When utilized in this mode, nut 32 is threadedly mated upon the lower end of bolt 12 so as to abut the lower surface 34 of form 14.

In order to provide additional retaining forces to the assembly 10 when the same is embedded within the poured concrete ceiling or roof, a nut 36 may optionally be threadedly secured upon the upper portion of anchor bolt 12. Nut 36 thus performs functions similar to nut 32 when the latter was embedded within the concrete slab or floor. It is also noted that the upper central portion of the base wall of washer 16 comprises a substantially planar annular rim 38. A radially extending slit 40 is formed within rim 38, and as best seen in FIG. 2, such slit permits the mating portions 42 and 44 of the rim 38 to be disposed upon different horizontal levels. In this manner, a lock washer or lock nut structure is formed. As a result, when nut 36 is threadedly moved downwardly along bolt 12, the higher portion 42 of rim 38 will be forced downwardly so as to perform its locking function. Nut 36 may then be optionally retained at such location, or alternatively, may be threadedly moved upwardly along bolt 12 to any one of a multitude of positions.

As noted hereinabove, when the apparatus 10 is employed in the latter mode, the concrete encapsulates the upper portion of bolt 12, washer 16, and nails 28. The concrete, however, does not penetrate interiorly of cup washer 16, and consequently, an open recessed cavity 46 will be defined about bolt 12 when nut 32 and form 14 are removed. In this manner, sufficient space is provided about bolt 12 in order to, for example, accommodate a particularly structured female connector which is adapted to be mated with the lower portion of bolt 12 which projects downwardly from the poured concrete roof or ceiling. In order to disengage form 14 from the poured concrete after the same has set hardened, nut 32 is initially removed, and subsequently, form 14 is, for example, pried loose from the lower ends of nails 28. The lowermost ends of nails will of course project downwardly below the planar surface of the poured concrete, however, if such is objectionable, the nail ends may be removed by wire cutters or other similar tools.

As further alternative modes of employing the assembly 10, the same may be arranged in a manner which is the reverse of that described hereinabove. In other words, when utilizing the assembly in conjunction with a concrete floor or slab, the assembly may be inverted from its disposition shown in FIG. 2 with the washer 16 disposed upright. In this manner, recessed cavities 46 may be provided within a floor or slab as opposed to being merely provided within a ceiling or roof. Similarly, if the assembly were utilized in its reverse mode, such recessed cavities could be optionally eliminated from a ceiling or roof.

Figure 3:
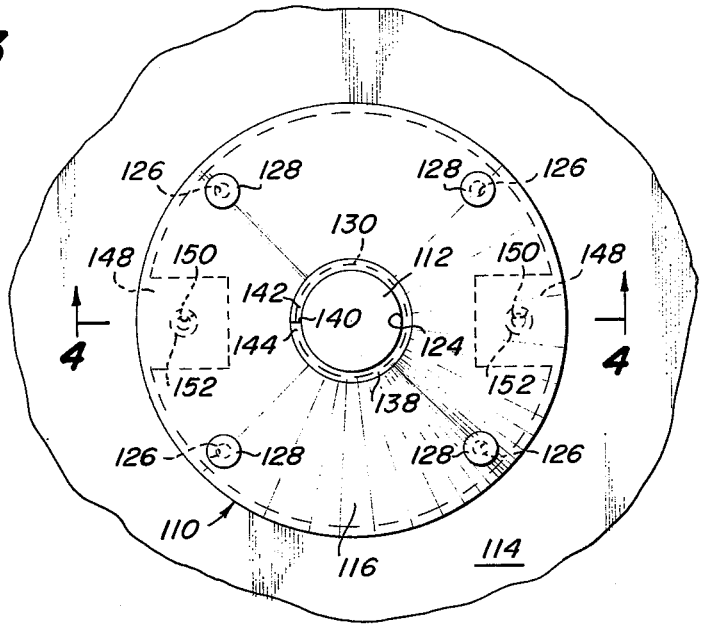
FIG. 3 is a view similar to that of FIG. 1, showing however a second embodiment of an anchor bolt assembly of the present invention.
Figure 4:
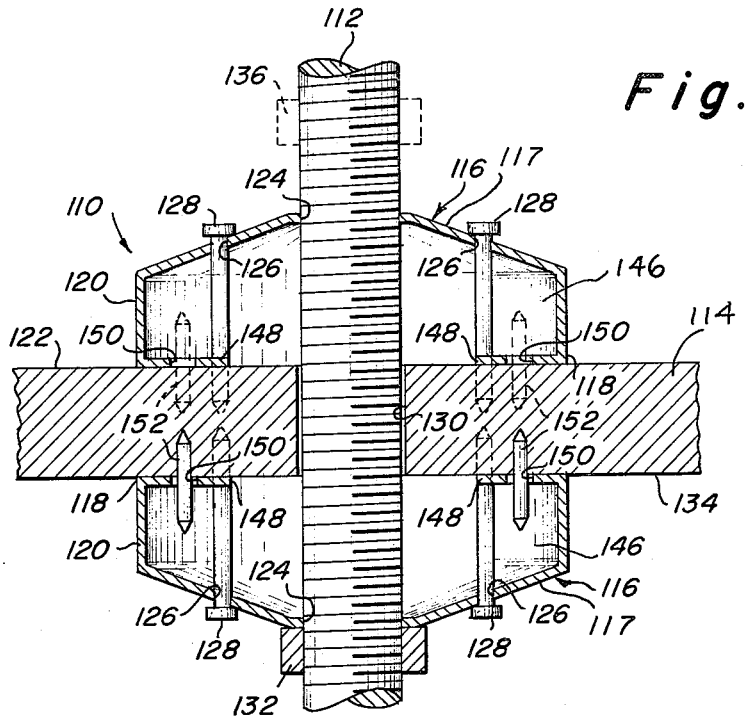
FIG. 4 is a cross-sectional view of the anchor bolt assembly of FIG. 3 taken along the line 4—4 of FIG. 3.

Referring now to FIGS. 3 and 4, a second embodiment of an anchor bolt assembly is disclosed. The reference characters of such an assembly are similar to those of the embodiment of FIGS. 1 and 2 except for the fact that the same are enumerated within a 100 series. As can be seen from the FIGURES, the embodiments of the assemblies are quite similar with the differences residing in the fact that two anchor assemblies similar to the assembly of FIGS. 1 and 2 are employed within the overall assembly 110 of FIGs. 3 and 4, and furthermore, additional mounting means, for locating the washers 116 upon form 114 at particularly defined locations thereof, are disclosed within the assembly embodiment of FIGS. 3 and 4.

The assembly of FIGS. 3 and 4 may be utilized, for example, as a pre-assembled assembly means when it is desired to use the form 114 successively for the formation of both a poured concrete floor and ceiling without the requirement of furnishing the form anew with additional anchor components except for the provision of a new anchor bolt 112. In addition, such an embodiment is likewise utilized only when recessed cavities 146 are desired to be formed about bolts 112 in both the ceiling and floor structures. Otherwise, if only one or none of the poured structures is to have such cavities, the embodiment of FIGS. 1 and 2 may be used in one of the alternative modes as described hereinabove.

As is seen from the FIGURES, each of the washers 116 is provided with a pair of diametrically opposed ears 148. The ears extend radially inwardly and are integrally formed with the free end 118 of the washer peripheral wall 120. Each of the ears is provided with an aperture 150. Pins or spikes 152 are adapted to be fixedly disposed within the upper or lower surface regions of form 114 at predetermined locations relative to through-bore 130 depending upon whether a ceiling or floor is initially to be formed. The diametrical extents of aperture 150 are slightly greater than those of spikes 152 in order to permit the washers 116 to be easily mounted upon spikes 152. It is noted that the drawing FIGURES show the relative diameters of the apertures and spikes in an exaggerated manner solely for clarity purposes. In actuality, the difference between such diametrical extents is somewhat less in order to maintain the accuracy of the disposition of bolt 112 within through-bore 130.

As a result of the provision of spikes 152 and apertured ears 148, bolt 112 need not necessarily be initially pre-assembled with one of the washers 116 when the apparatus 110 is assembled. To the contrary, when initially forming a concrete floor or slab, for example, spikes may be inserted within the lower surface region of the form 114 at their predetermined locations relative to through-bore 130, and subsequently, the lower washer 116 may be mounted upon form 114 by means of the relative alignment between apertures 150 and spikes 152. Nails 128 may then be inserted through holes 126 and driven into form 114 so as to fixedly secure the lower washer 116 upon the form. As the aperture 124 of the lower washer 116 is aligned with through-bore 130, bolt 112 may then be threadedly inserted within the lower washer 116 and disposed through through-bore 130. The upper washer may then be threadedly disposed upon the upper end of bolt 112 so as to perform a function similar to that of nut 32 as described in connection with the embodiment of FIGS. 1 and 2, although in an inverted or reverse mode. Nails 128 may also preferably be inserted through the holes 126 of the upper washer and driven into the upper region of form 114 for purposes which will be described more fully hereinafter.

Upon completion of the foregoing assembly steps, a nut 132 may be disposed upon the lower end of bolt 112 for anchoring purposes similar to those noted in conjunction with nut 32 of the assembly 10 of FIGS. 1 and 2 and also for the lock nut or lock washer function discussed in conjunction with nut 36 of assembly 10. The concrete may then be poured into the area disposed beneath form 114. Upon set hardening, the upper washer 116 is initially threadedly disengaged from the upper section of bolt 112. If nails 128 were also employed within the upper portion of the assembly 110, then these must of course be removed prior to the threaded disengagement of upper washer 116. Upon completion of these steps, form 114 may be lifted clear of bolt 112, along with spikes 152 disposed within the lower surface region of form 114. The upper projecting ends of nails 128 operatively connected to lower washer 116 may of course be severed by means of wire cutters or other similar tools.

It is to be particularly noted that the location-spikes 152 cannot be employed simultaneously within both the upper and lower regions of form 114 in order to facilitate the disassembly of the apparatus upon completion of the pouring of a concrete structure and the set hardening of the same. For this reason, the spikes within the upper region of form 114 are shown in phantom, it being understood however that if a concrete ceiling were first being formed, then such spikes would be illustrated by solid lines while the spikes within the lower surface region of form 114 would be illustrated in phantom lines. Alternatively, in lieu of using two washers 116, one of the washers 116 may be utilized with a washer 16.

It is to be noted further that when the nails 128 are employed within the upper region of the assembly 110 when the concrete floor or slab is being formed, upon removal of such nails and the upper washer 116, nail holes will of course be present within the upper surface region of form 114 relative to through-bore 130. Consequently, when the apparatus is then subsequently utilized in forming a concrete ceiling or roof, nails 128 may readily be re-inserted through holes 126 within the upper washer 116 and driven back into the existing nail holes within the upper region of form 114. Consequently, the need for spikes 152 within the upper region of form 114 for aligning the upper washer 116 during this stage of the entire process is obviated. A new bolt 112 may then be threadedly inserted through the upper washer 116 and passed through through-bore 130. A new nut 132 may be secured upon the lower portion of bolt 112, and similarly, a nut 136 may be secured upon the upper end of bolt 112 for purposes similar to those described in conjunction with nut 36.

Spikes 152 disposed within the lower surface region of form 114 may be maintained therewithin during the formation of the ceiling or roof. Upon the set hardening of the ceiling or roof, nut 132 may be threadedly disengaged from the lower end of bolt 112 whereupon form 114, along with spikes 152, may be disengaged from the lower ends of nails 128. The projecting ends of nails 128 may be severed by means of, for example, wire cutters or other similar tools, and the form 114, along with the spikes 152 disposed within the lower surface region thereof is again ready to be assembled with new washers 116, nails 128, anchor bolts 112, and nuts 132 and 136 in order to construct new concrete floors, ceilings, walls, or columns.

Obviously, many modifications and variations of the present invention are possible in light of the above teachings. It is therefore understood that within the scope of the appended claims, the present invention may be practiced otherwise than as specifically described herein.

What is claimed as new and desired to be secured by Letters Patent of the United States is:

1. An anchor bolt assembly adapted for connection with a form (14) for pouring concrete, said form containing a through bore (30), comprising (a) an anchor bolt (12) adapted for insertion through the bore in said form for permanent mounting at one end in the concrete;

(b) at least one cup-shaped member (16) including a circular generally disk-shaped body portion (17), and an annular generally cylindrical spacer flange portion (20) connected at one end with the peripheral edge portion of said body portion, said body portion containing a central aperture (24) receiving said anchor bolt, said body portion also containing a plurality of fastening apertures (26) arranged in spaced relation about said central aperture, the other end (18) of said cylindrical flange portion being adapted for seating engagement with one side of said form in concentrically spaced relation to the through bore contained therein; and (c) a plurality of fastener elements (28) extending through said fastening apertures in said disk-shaped body portion and axially in spaced relation through said cylindrical spacer portion for connection with the form, thereby to properly orient said anchor bolt relative to said form.

2. Apparatus as defined in claim 1, wherein the central aperture wall of said disk-shaped body portion is threadedly connected with said anchor bolt.

3. Apparatus as defined in claim 1, and further including a first anchoring nut (36) threadedly connected with said anchor bolt for engagement with said disk-shaped body portion.

4. Apparatus as defined in claim 3, wherein said disk-shaped body portion contains a slit (40) extending radially from said central aperture, the portions (42, 44) of said disk-shaped body portion being slightly deformed to define means for locking said first nut against rotation.

5. Apparatus as defined in claim 3, and further including a second anchor nut (32) threadedly connected with said anchor on the opposite side of the form from said cup-shaped member.

6. Apparatus as defined in claim 5, and further including a second cup-shaped member mounted on said anchor bolt and arranged between said second anchor nut and the said other side of the form, said second cup-shaped member being arranged with its said other end of the cylindrical spacer flange portion in contiguous engagement with the other side of the form, and a plurality of further fastener means extending through the fastening apertures in said second cup-shaped member for connection with the form.

7. Apparatus as defined in claim 6, wherein each of said cup-shaped members includes at the said other end of said cylindrical flange portion at least two diametrically opposed radially inwardly directed apertured ear means cooperating with locator pins inserted within said form means for prelocating the position of at least one of said washer means relative to said form means.

* * * * *